US007104095B1

(12) United States Patent
Lin

(10) Patent No.: US 7,104,095 B1
(45) Date of Patent: Sep. 12, 2006

(54) BUCKLE LOCK WITH LOCK INDICATING WINDOW

(76) Inventor: Fu Chuan Lin, No. 3, Lane 88, Sec. 1, Jhongsing Rd., Wugu Township, Taipei County (TW)

( * ) Notice: Subject to any disclaimer, the term of this patent is extended or adjusted under 35 U.S.C. 154(b) by 0 days.

(21) Appl. No.: 11/317,740

(22) Filed: Dec. 23, 2005

(51) Int. Cl.
*E05B 73/00* (2006.01)

(52) U.S. Cl. ..... 70/58; 70/284; 70/285; 70/DIG. 63

(58) Field of Classification Search ..... 70/21, 70/58, 284, 285, DIG. 63
See application file for complete search history.

(56) References Cited

U.S. PATENT DOCUMENTS 4,912,950 A * 4/1990 Crowle ..... 70/58
5,193,368 A * 3/1993 Ling ..... 70/57
5,692,403 A * 12/1997 Ling ..... 70/57
6,016,675 A * 1/2000 Te ..... 70/312
6,684,667 B1 * 2/2004 Young ..... 70/58
6,883,354 B1 * 4/2005 Yu ..... 70/58
6,912,879 B1 * 7/2005 Yu ..... 70/58
6,928,842 B1 * 8/2005 Huang ..... 70/284
7,007,520 B1 * 3/2006 Lin ..... 70/284
2005/0155397 A1 * 7/2005 Yu ..... 70/58
2006/0081022 A1 * 4/2006 Yu ..... 70/58

* cited by examiner

*Primary Examiner*—Suzanne Dino Barrett
*Assistant Examiner*—Christoper Boswell
(74) *Attorney, Agent, or Firm*—Pro-Techtor Int'l Services

(57) ABSTRACT

A buckle lock includes a casing, a lever on the casing and including two front bottom legs and a rear button, a tumbler wheel assembly including a spring biased shaft having a rear slope, a sliding block in the chamber and having a transverse passage, a key turning assembly including an inward protrusion and a key shaft, a sliding member on the key shaft and including a wedge, an opposite projecting bar, and a top mark aligned with the window when the key turning assembly is operable, and a tongue. Turning the dials to a correct combination and pressing the button will enable a manipulation of the wedge for sliding the sliding member toward the sliding block until the sliding block is blocked by the engaged projecting bar and the mark is misaligned with the window, thereby visually informing a person that the key turning assembly is disabled.

2 Claims, 7 Drawing Sheets

BUCKLE LOCK WITH LOCK INDICATING WINDOW

BACKGROUND OF THE INVENTION

1. Field of Invention

The present invention relates to buckles and more particularly to a buckle including a tumbler wheel assembly such that the buckle can be open or closed by operating as a combination lock, a key turning assembly such that the buckle can also be open or closed by operating as a padlock, and means for locking and unlocking the key turning assembly and visually informing a person to stop inserting a key into the key turning assembly for opening if the key turning assembly has been locked.

2. Related Art

U.S. Pat. No. 6,912,879 B1 describes a locking apparatus combined with a fastener for controlling locking/unlocking thereof. The locking apparatus is shaped as a buckle and comprises a numeral wheel locking unit (i.e., served as a typical combination lock), a controlling unit (i.e., served as a typical padlock), and male and female fasteners (i.e., served as a typical seat belt buckle). Owner of the locking apparatus may open or close it by operating as a combination lock or padlock. This patent may facilitate a customs officer to open a luggage locked by the locking apparatus by inserting a standard key into a keyhole of the controlling unit. However, its operation is still not convenient and its construction is somewhat complex. Moreover, another person is not aware whether the lock can be opened by a key by simply visually observing the lock. Thus, the need for improvement still exists.

SUMMARY OF THE INVENTION

It is therefore an object of the present invention to provide a buckle lock comprising a casing including a central channel, a forward opening in communication with the channel, an intermediate tunnel in communication with the channel, and a rear chamber in communication with the channel through the tunnel, the chamber including a slot aligned with the tunnel and being in communication with the channel; a lever fitted on the channel and including two front bottom legs and a rear button on its top; a tumbler wheel assembly including a plurality of rotatable dials and a spring biased shaft passed through the dials, the shaft including a rear slope; a sliding block disposed in the chamber and including a front wedge fitted in the tunnel and a transverse passage; a key turning assembly disposed in the chamber and including a keyhole and an inward protrusion having a cam section disposed in the passage; a cover fitted on the chamber; and a tongue including a rear tongue plate having a shoulder wherein in a closed position of the buckle lock, the tongue plate is inserted into the opening with the legs lockingly engaged with the shoulder; whereby turning the dials until a correct combination is shown will enable the shaft to move axially to disengage with the wedge for unlocking the lever such that pressing the button will disengage the legs with the shoulder and pulling the tongue out of the casing will unlock the buckle lock; and inserting a key into the keyhole to turn the key turning assembly about 180 degrees will move the sliding block rearward to partially dispose in the slot for disengaging the trigger with the wedge for unlocking the lever such that pressing the button will disengage the legs with the shoulder and pulling the tongue out of the casing will unlock the buckle lock.

It is another object of the present invention to provide a buckle lock comprising a casing including a top window, a central channel, a forward opening in communication with the channel, an intermediate tunnel in communication with the channel, and a rear chamber in communication with the channel through the tunnel, the chamber including a slot aligned with the tunnel and being in communication with the channel; a lever fitted on the channel and including two front bottom legs and a rear button on its top; a tumbler wheel assembly including a plurality of rotatable dials and a spring biased shaft passed through the dials, the shaft including a rear slope; a sliding block disposed in the chamber and including a front wedge fitted in the tunnel and a transverse passage; a key turning assembly disposed in the chamber and including a keyhole, an inward protrusion having a cam section disposed in the passage, and a key shaft extended inwardly from the protrusion; a sliding member slidably mounted on the key shaft and including a wedge-shaped element at one side in communication with the channel, a projecting bar at the other side, and a top mark aligned with the window when the key turning assembly is adapted to operate; a cover fitted on the chamber; and a tongue including a rear tongue plate having a shoulder wherein in a closed position of the buckle lock, the tongue plate is inserted into the opening with the legs lockingly engaged with the shoulder; whereby turning the dials until a correct combination is shown will enable the shaft to move axially to disengage with the wedge for unlocking the lever such that pressing the button will disengage the legs with the shoulder and pulling the tongue out of the casing will unlock the buckle lock; inserting a key into the keyhole to turn the key turning assembly about 180 degrees will move the sliding block rearward to partially dispose in the slot for disengaging the trigger with the wedge for unlocking the lever such that pressing the button will disengage the legs with the shoulder and pulling the tongue out of the casing will unlock the buckle lock; and turning the dials until a correct combination is shown and pressing the button will enable a manipulation of the wedge-shaped element for sliding the sliding member along the key shaft toward the sliding block until being stopped with the sliding block being blocked by the engaged projecting bar and the mark being misaligned with the window, thereby visually informing a person that inserting the key into the key turning assembly for opening the buckle lock is not possible after releasing the button.

The above and other objects, features and advantages of the present invention will become apparent from the following detailed description taken with the accompanying drawings.

DETAILED DESCRIPTION OF THE INVENTION

Figure 1:
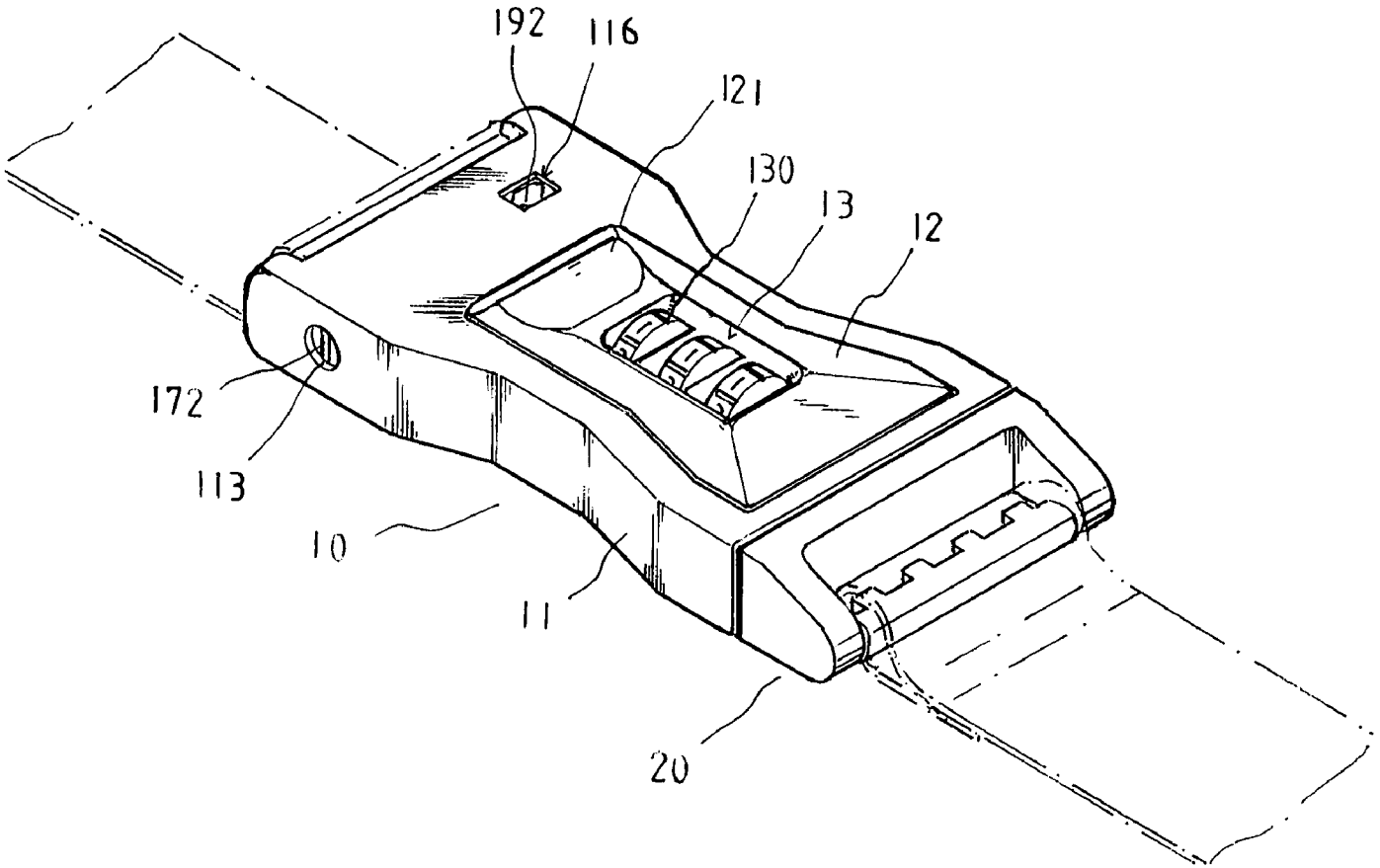
FIG. 1 is a perspective view of a buckle lock according to the invention.
Figure 2:
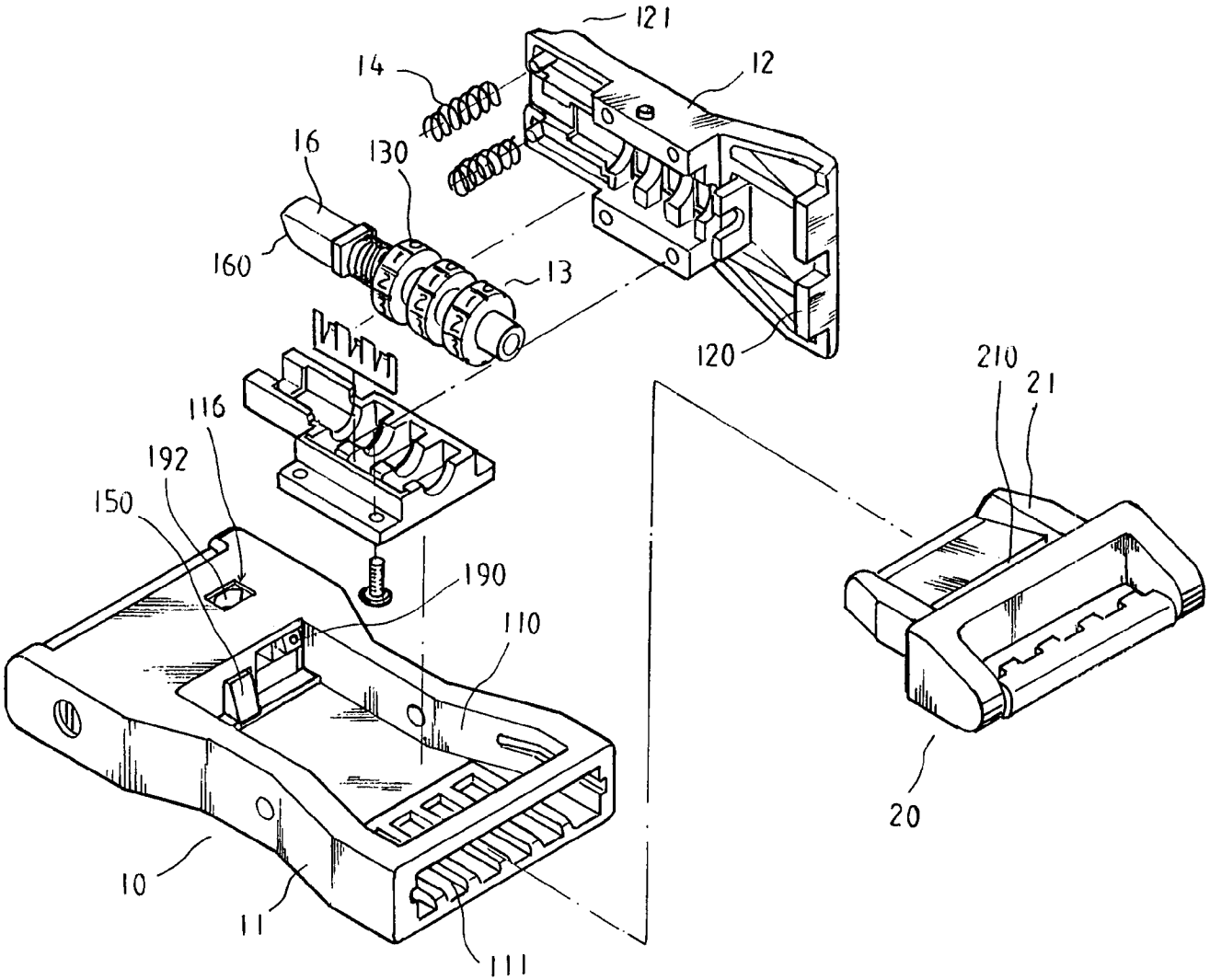
FIG. 2 is an exploded view of a tumbler wheel assembly and other associated components of the buckle lock.

Referring to FIGS. 1 to 11, a buckle lock in accordance with the invention comprises a buckle casing 10 including a substantially rectangular hollow frame 11 including a central channel 110, a forward opening 111 in communication with the channel 110, a rear chamber 114 in communication with the channel 110, a rear slot 112 in the chamber 114 and being in communication with the channel 110, a hole 113 on a side surface of the casing 10 and being in communication with the slot 112, and two seats 115 in the chamber 114 with the slot 112 disposed between the seats 115; a lever 12 snugly fitted on the channel 110 and including two front bottom legs 120 and a rear button 121 on its top; a tumbler wheel assembly 13 including three rotatable dials 130 with numerals printed thereon and a spring biased shaft 131 passed through central bores of the dials 130; a trigger 16 formed at a rear end of the shaft 131 and including a slope 161 at its rear end; two springs 14 anchored between the lever 12 and a plate secured to a bottom of the channel 110 such that the lever 12 may operate as a lever device; a parallelepiped sliding block 15 in the chamber 114 and including a front wedge 150 fitted in a tunnel between the chamber 114 and the channel 110, and a transverse passage 151; a cylindrical key turning assembly 17 disposed on the seats 115 and including a keyhole 172 in the hole 113, an inward protrusion 171 having a cam section disposed in the passage 151, and a key shaft 170 extended from the protrusion 171; and a cover 18 snugly fitted on a top of the chamber 114 for enclosing the key turning assembly 17 and the sliding block 15.

The buckle lock further comprises a tongue 20 including a rear tongue plate 21 having a shoulder 210. In a closed position of the buckle lock, the tongue plate 21 is inserted into the opening 111 with the legs 120 lockingly engaged with the shoulder 210.

Figure 4:
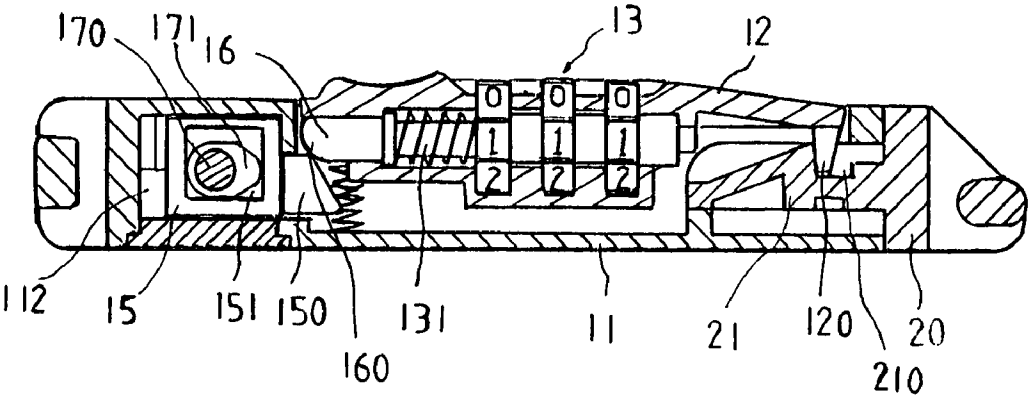
FIG. 4 is a longitudinal sectional view of the buckle lock in its closed position.
Figure 5:
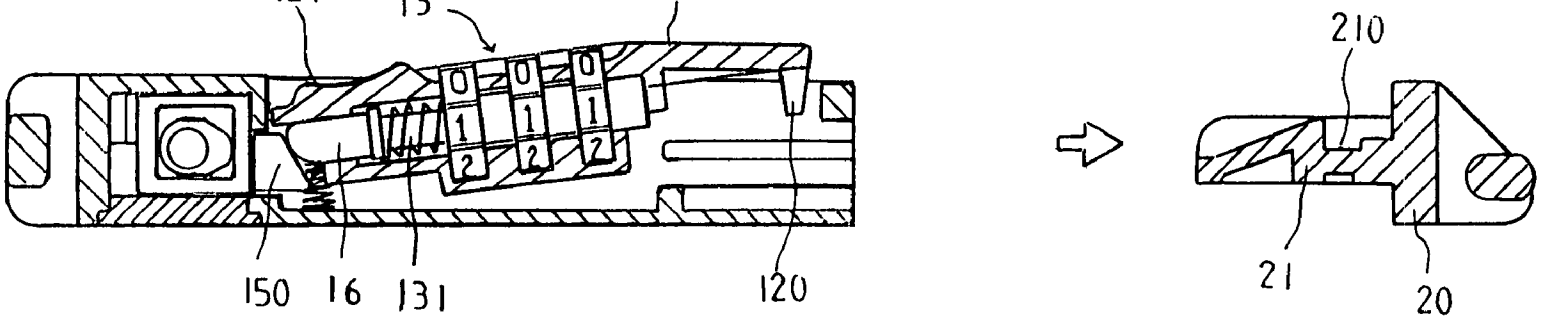
FIG. 5 is a view similar to FIG. 4 where the buckle lock is open by disengaging a tongue by pressing a button after turning dials to a correct combination.

Referring to FIGS. 4 and 5 specifically, an unlocking operation of the invention will now be described in detail below. In a normal case a person can turn the dials 130 until the correct set series of numbers (i.e., combination) are shown on a top opening of the lever 12. At this moment, both the shaft 131 and the trigger 16 are adapted to move axially to cause the trigger 16 to disengage with the wedge 150. Also, the lever 12 is unlocked. Thus, a person may press the button 121 to disengage the legs 120 with the shoulder 210. Eventually, the person may pull the tongue 20 out of the buckle casing 10 to unlock the buckle lock.

Figure 6:
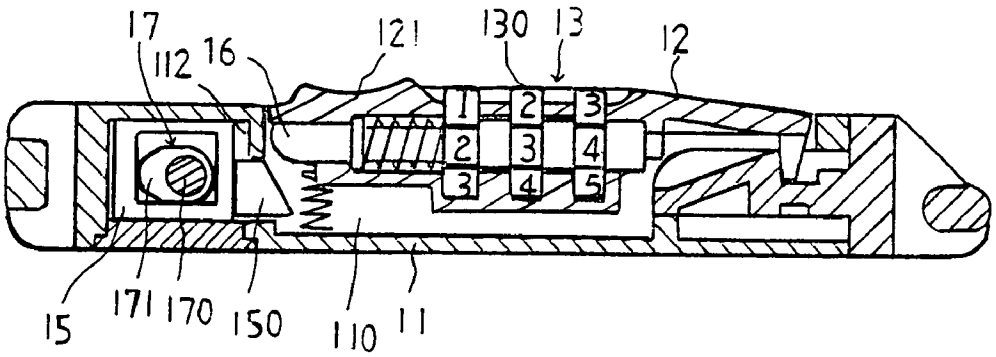
FIG. 6 is a view similar to FIG. 4 where the lever is unlocked by inserting a key into a keyhole and turning same until been stopped.
Figure 7:
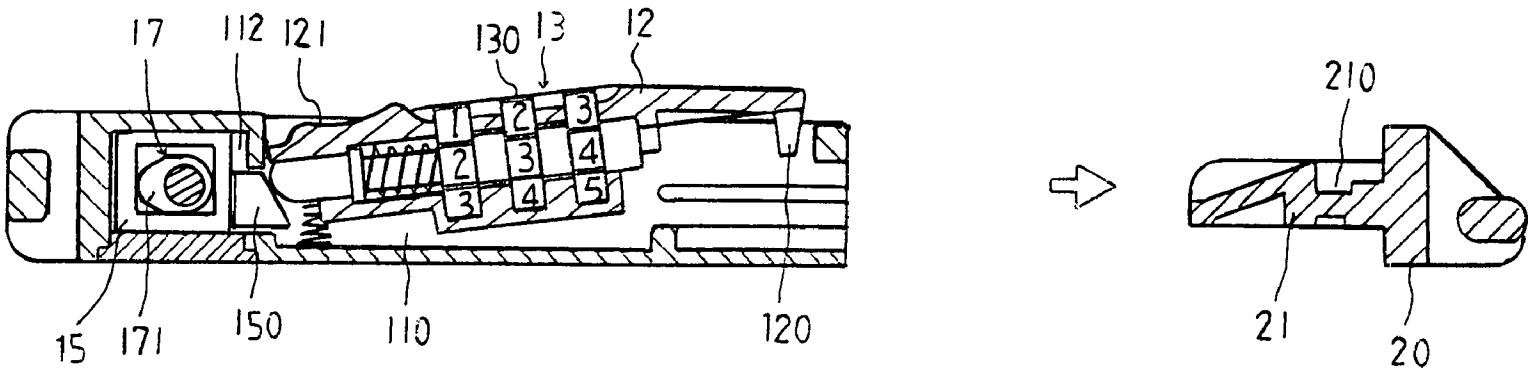
FIG. 7 is a view similar to FIG. 4 where the buckle lock is open by disengaging a tongue by pressing the button after the lever has been unlocked by turning the key in the keyhole.

Referring to FIGS. 6 and 7 specifically, an operation of enabling a person to open the lock by a key either should the combination be forgotten, the combination has been changed by another person who shares the ownership of the lock, or by a customs officer who suspects the contents of a luggage or the like locked by the buckle lock will now be described in detail below. A person can insert a key into the keyhole 172 to turn the key turning assembly 17 (i.e., the protrusion 171) about 180 degrees so as to move the sliding block 15 (i.e., the wedge 150) rearward from the position shown in FIG. 5 to the position shown in FIG. 6 (i.e., more space of the slot 112 is occupied by the sliding block 15). Thus, the trigger 16 disengages with the wedge 150 (i.e., the lever 12 is unlocked). Thus, the person may press the button 121 to disengage the legs 120 with the shoulder 210. Eventually, the person may pull the tongue 20 out of the buckle casing 10 to unlock the buckle lock.

Figure 3:
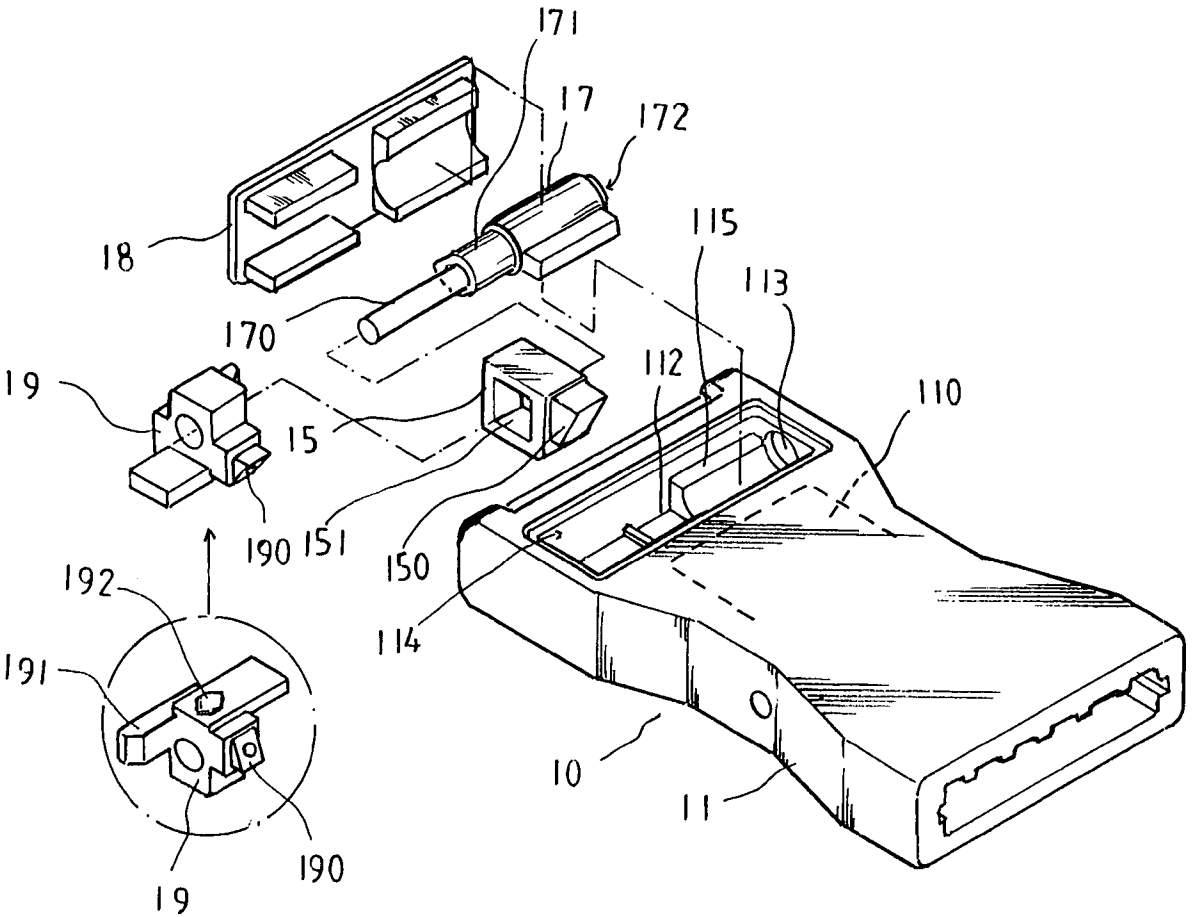
FIG. 3 an exploded view of a key turning assembly and other associated components of the buckle lock.
Figure 8:
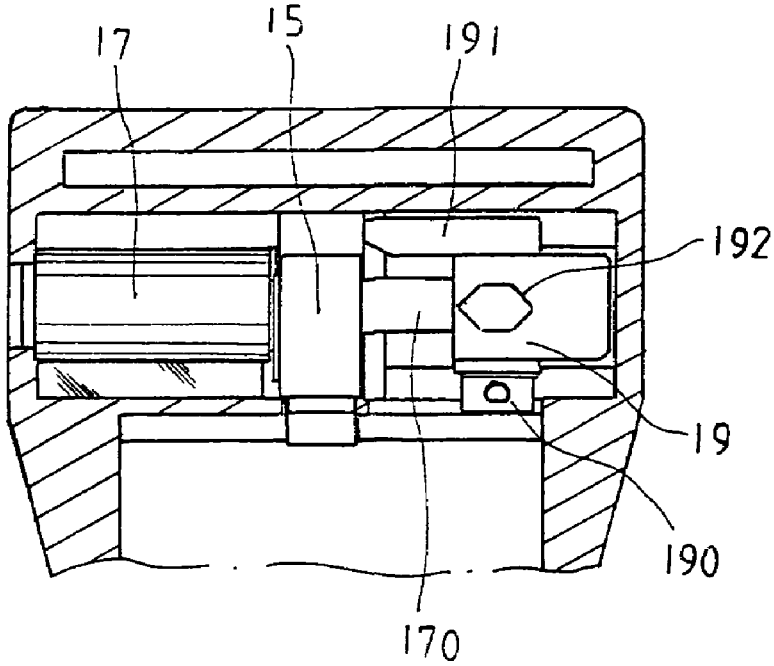
FIG. 8 is a sectional view showing the projecting bar disengaged with the sliding block.
Figure 9:
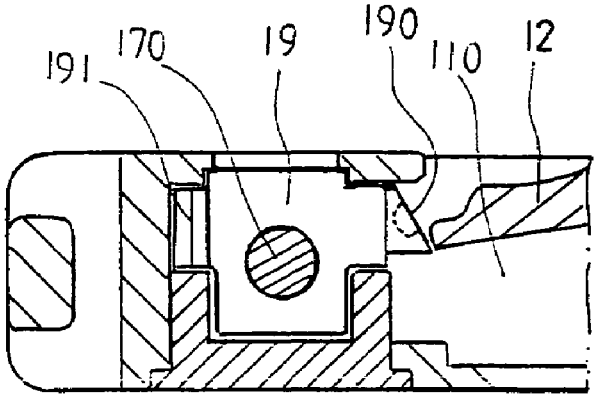
FIG. 9 is a longitudinal sectional view of a forward portion of the buckle lock showing the lever being pressed.
Figure 10:
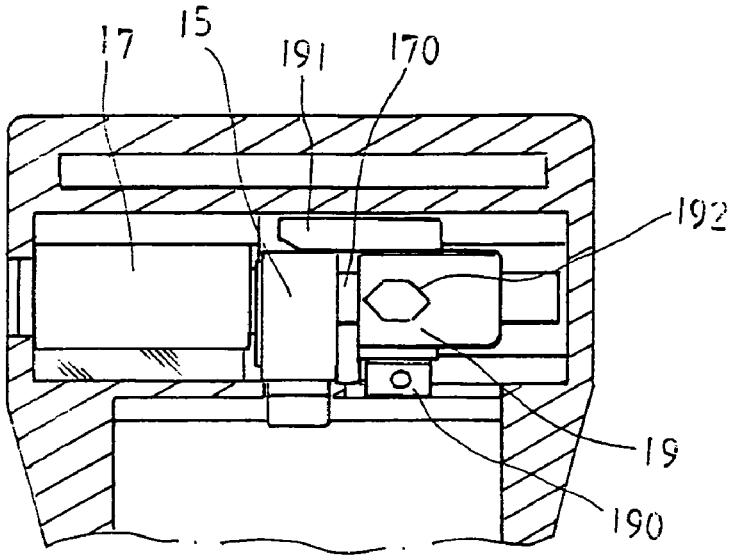
FIG. 10 is a view similar to FIG. 8 showing the projecting bar engaged with the sliding block.
Figure 11:
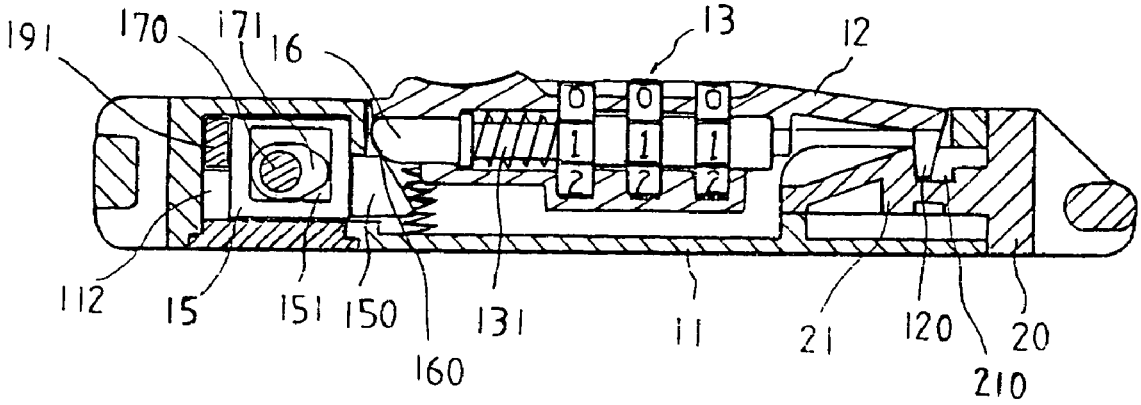
FIG. 11 a longitudinal sectional view of the buckle lock in its closed position and the key turning assembly is also disabled.

Referring to FIGS. 8 to 11 specifically in conjunction with FIGS. 1 and 3, a sliding member 19 is slidably mounted on the key shaft 170. The sliding member 19 comprises a wedge-shaped element 190 at one side in communication with the channel 110, a projecting bar 191 at the other side, and a top mark 192. As stated above, a person may press the button 121 to unlock the buckle lock when the correct combination is shown on the top opening of the lever 12. At this time, the person may manipulate the wedge-shaped element 190 exposed to the channel 110 so as to slide the sliding member 19 along the key shaft 170 toward the sliding block 15 until being stopped. As shown in FIG. 10, the sliding block 15 is prevented from moving toward the channel 110 since the sliding block 15 is blocked by the sliding member 191. That is, the buckle lock cannot be opened by inserting a key into the keyhole 172 to turn the key turning assembly 17 after releasing the button 121.

A window 116 is formed on top of the buckle casing 10. The window 116 is aligned with the mark 192 for indicating that a person may use a key to open the buckle lock. To the contrary, the window 116 is not aligned with the mark 192 when the sliding block 15 is locked by the sliding member 191. This can visually inform a person to stop inserting a key into the key turning assembly 17 for opening since the key turning assembly 17 has been locked. For permitting a person to operate the key turning assembly 17 again by visually observing the mark 192 in the window 116, the steps discussed with reference to FIGS. 8 to 10 are traversed in the opposite direction.

While the invention herein disclosed has been described by means of specific embodiments, numerous modifications and variations could be made thereto by those skilled in the art without departing from the scope and spirit of the invention set forth in the claims.

What is claimed is:

1. A buckle lock comprising:

a casing including a central channel, a forward opening in communication with the channel, an intermediate tunnel in communication with the channel, and a rear chamber in communication with the channel through the tunnel, the chamber including a slot aligned with the tunnel and being in communication with the channel;

a lever fitted on the channel and including two front bottom legs and a rear button on its top;

a tumbler wheel assembly including a plurality of rotatable dials and a spring biased shaft passed through the dials, the shaft including a rear slope acting as a trigger;

a sliding block disposed in the chamber and including a front wedge fitted in the tunnel and a transverse passage;

a key turning assembly disposed in the chamber and including a keyhole and an inward protrusion having a cam section disposed in the passage;

a cover fitted on the chamber; and a tongue including a rear tongue plate having a shoulder wherein in a closed position of the buckle lock, the tongue plate is inserted into the opening with the legs lockingly engaged with the shoulder; whereby turning the dials until a correct combination is shown will enable the shaft to move axially to disengage with the wedge for unlocking the lever such that pressing the button will disengage the legs with the shoulder and pulling the tongue out of the casing will unlock the buckle lock; and inserting a key into the keyhole to turn the key turning assembly about 180 degrees will move the sliding block rearward to partially dispose in the slot for disengaging the trigger with the wedge for unlocking the lever such that pressing the button will disengage the legs with the shoulder and pulling the tongue out of the casing will unlock the buckle lock.

2. A buckle lock comprising:

a casing including a top window, a central channel, a forward opening in communication with the channel, an intermediate tunnel in communication with the channel, and a rear chamber in communication with the channel through the tunnel, the chamber including a slot aligned with the tunnel and being in communication with the channel;

a lever fitted on the channel and including two front bottom legs and a rear button on its top;

a tumbler wheel assembly including a plurality of rotatable dials and a spring biased shaft passed through the dials, the shaft including a rear slope acting as a trigger;

a sliding block disposed in the chamber and including a front wedge fitted in the tunnel and a transverse passage;

a key turning assembly disposed in the chamber and including a keyhole, an inward protrusion having a cam section disposed in the passage, and a key shaft extended inwardly from the protrusion;

a sliding member slidably mounted on the key shaft and including a wedge-shaped element at one side in communication with the channel, a projecting bar at the other side, and a top mark aligned with the window when the key turning assembly is adapted to operate;

a cover fitted on the chamber; and a tongue including a rear tongue plate having a shoulder wherein in a closed position of the buckle lock, the tongue plate is inserted into the opening with the legs lockingly engaged with the shoulder; whereby turning the dials until a correct combination is shown will enable the shaft to move axially to disengage with the wedge for unlocking the lever such that pressing the button will disengage the legs with the shoulder and pulling the tongue out of the casing will unlock the buckle lock;

inserting a key into the keyhole to turn the key turning assembly about 180 degrees will move the sliding block rearward to partially dispose in the slot for disengaging the trigger with the wedge for unlocking the lever such that pressing the button will disengage the legs with the shoulder and pulling the tongue out of the casing will unlock the buckle lock; and turning the dials until a correct combination is shown and pressing the button will enable a manipulation of the wedge-shaped element for sliding the sliding member along the key shaft toward the sliding block until being stopped with the sliding block being blocked by the engaged projecting bar and the mark being misaligned with the window, thereby visually informing a person that inserting the key into the key turning assembly for opening the buckle lock is not possible after releasing the button.

* * * * *